US005241240A

United States Patent [19]

Chen et al.

[11] Patent Number: 5,241,240

[45] Date of Patent: Aug. 31, 1993

[54] HOLLOW CHAIN LINK MAIN LENS DESIGN FOR COLOR CRT

[75] Inventors: Hsing-Yao Chen, Barrington, Ill.; Sen-Su Tsai, Taoyuan, Taiwan

[73] Assignee: Chunghwa Picture Tubes, Ltd., China

[21] Appl. No.: 890,836

[22] Filed: Jun. 1, 1992

[51] Int. Cl.[5] ..... H01J 29/48

[52] U.S. Cl. ..... 313/414; 313/412; 315/15

[58] Field of Search ..... 313/414, 412; 315/15

[56] References Cited

U.S. PATENT DOCUMENTS

| | | | |
|---|---|---|---|
| 4,400,649 | 8/1983 | Chen | 313/414 |
| 4,520,292 | 5/1985 | van Hekken et al. | 313/412 |
| 4,764,704 | 8/1988 | New et al. | 313/414 |
| 4,800,318 | 1/1989 | Naiki | 313/414 |
| 5,027,043 | 6/1991 | Chen et al. | 315/368 |
| 5,036,258 | 7/1991 | Chen et al. | 315/382 |
| 5,043,625 | 8/1991 | Chen | 313/414 |
| 5,170,101 | 12/1992 | Gorski et al. | 315/368.11 |

OTHER PUBLICATIONS

*Quadrupole Lens for Dynamic Focus and Astigmatism Control in an Elliptical Aperture Lens Gun,* Shirai et al., pp. 163–165, SID 87 Digest, 1987.

*Dynamic Astigmatism Control Quadra Potential Focus Gun for 21-in. Flat Square Color Display Tube,* Katsuma et al., pp. 136–139, SID 8 Digest, 1988.

*An Overview of the COTY-29 Tube System An Improved Generation of Color Picture Tubes,* A. M. Morrell, pp. 290–295, IEEE Transactions on Consumer Electronics vol. CE-28, No. 3, Aug., 1982.

*Interdigital Grids for Dynamic Astigmatism Control in Picture-Tube Guns,* Bloom et al., pp. 777–784, IEEE Transactions on Electron Devices, vol. 36, No. 4, Apr., 1989.

*Primary Examiner*—Sandra L. O'Shea

*Attorney, Agent, or Firm*—Emrich & Dithmar

[57] ABSTRACT

An inline electron gun for use in a multi-beam color cathode ray tube (CRT) has a main focus lens for focusing the electron beams on a display screen of the CRT. The main focus lens includes adjacent charged electrodes each having chain link-type common lens apertures through which the electron beams are directed and which are in facing relation for reducing horizontal spherical aberration of the electron beams on the CRT display screen, where each common lens aperture has a longitudinal axis aligned with the inline electron beams. Each common lens aperture includes spaced, vertically enlarged portions, each aligned with a respective electron beam, for correcting for vertical spherical aberration of the electron beams. Increasing the vertical dimension of that portion of each of the common lens apertures aligned with a respective electron beam reduces the vertical spot size of the electron beam without degrading other electron gun operating characteristics. The chain link-type common lens is defined by a thin peripheral side wall parallel to the beam axis which may also be used in other embodiments such as in combination with facing conventional solid (double side wall) or hollow (single side wall) common lens structures in adjacent electrodes in the main focus lens. The chain link-type common lens aperture may be either disposed in an inwardly directed end wall of the electrode or it may be defined by a straight side wall of the electrode aligned with the electron gun axis.

17 Claims, 9 Drawing Sheets

38
36
34
34a 32
106
104
$V_A$ 30
SOURCE
$G_4$
5b
42
5b
5a
40
5a
$V_F$ 28
SOURCE
26
$G_3$
13a
13b
13c
$G_2$
$G_1$
11a
11b
11c
$K_R$
$K_G$
$K_B$

FIG. 5a
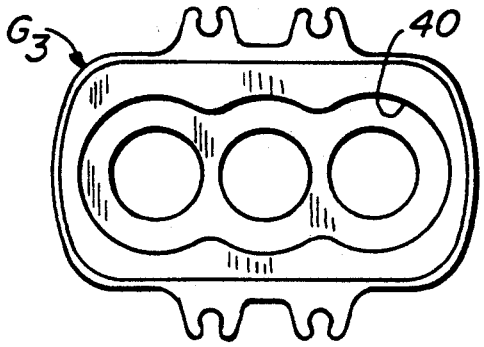
FIG. 5b
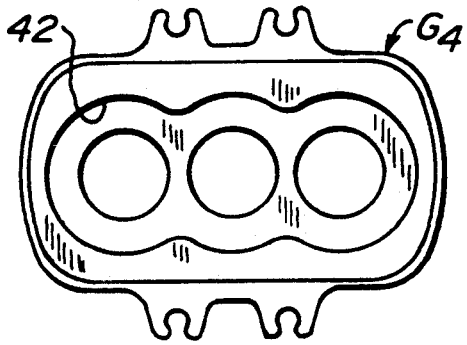
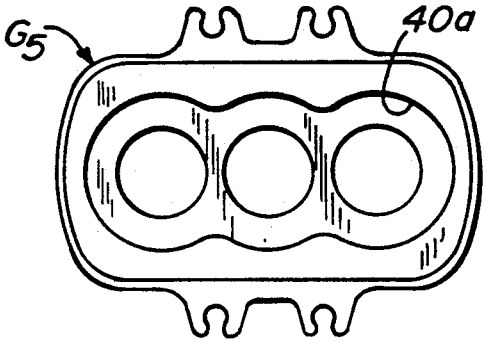
FIG. 6a
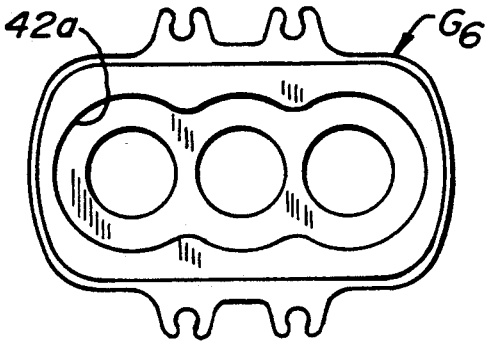
FIG. 6b
FIG. 8a
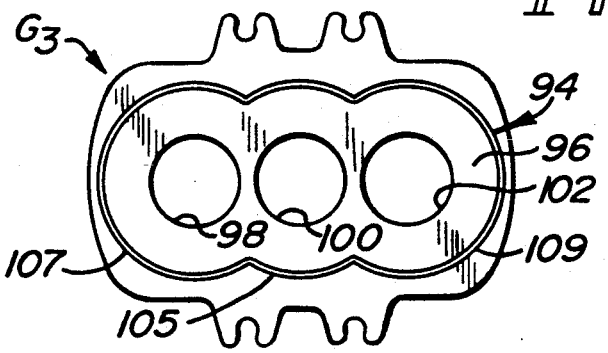
FIG. 8b
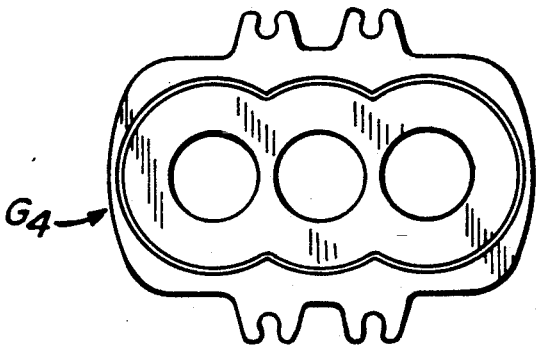

HOLLOW CHAIN LINK MAIN LENS DESIGN FOR COLOR CRT

FIELD OF THE INVENTION

This invention relates generally to multi-electron beam color cathode ray tubes (CRTs) and is particularly directed to an inline electron gun and a focus electrode therein for correcting for spherical aberration in a color CRT.

BACKGROUND OF THE INVENTION

In the past twelve years, design of the high resolution color CRT electron gun has evolved from the individual type of main lens design to the common lens type design. In the individual type main lens design, inside each of the three guns (red, blue, green) the electron beam goes through an individually defined lens space without sharing this space with its neighbors. FIG. 1 is a simplified sectional view of a conventional individual type main lens 10 shown in terms of an optical analogy with three light beams. This type of design is simple and straightforward. However, the drawback of this design is that each gun has a very limited space, resulting in high spherical aberration and generally poor electron beam spot resolution at high beam current.

The so-called "common lens" design has a single, shared aperture for the three electron beams. Each of the three beams goes through its own individual beam path, plus a shared focusing region, as shown in the simplified sectional views of FIGS. 2*a* and 2*b* of a conventional common lens type main lens 12 such as used in a color CRT. The common lens design dramatically reduces spherical aberration in the horizontal direction (in the plane of FIG. 2*a*) and also somewhat reduces spherical aberration in the vertical direction (in the plane of FIG. 2*b*).

FIGS. 3*a*, 3*b* and 3*c* show various views of a so-called "solid common lens" 14 which has a shared lens focusing space. The rim 16 of the solid common lens 14 is defined by a doubly bent sheet of metal. This structure, called a solid common lens, makes the part mechanically stronger, but at the same time its opening, or the shared lens focusing space of the lens, is restricted by the double layered rim 16 which limits the extent of spherical aberration correction.

FIGS. 4*a*, 4*b* and 4*c* show various views of another type of common lens structure—the hollow common lens 18. In this type of design, the wall 20 of the common lens 18 is a single-layer sheet of metal. In a defined CRT neck size, a hollow common lens will have less lens spherical aberration compared to a solid common lens situated in the same neck size. However, the inward directed portion 20*a* of wall 20 also limits the extent of spherical aberration correction available in this type of common lens. Hollow common lens 18 is shown in FIG. 4*b* as including a conventional "body" portion 18*a*.

Another variable in the common lens design is the shape of the lens. As shown in the racetrack shape of FIG. 3*a* as well as the dogbone shape of FIG. 4*a*, in both the solid and hollow common lens designs the horizontal edges of the center gun are straight and parallel. This causes the center (green) gun to have a higher astigmatism than the two outer guns (red, blue).

The present invention addresses the aforementioned limitations of the prior art by providing a chain link-type common lens aperture in an electron gun main focus lens electrode having a thin peripheral side wall aligned parallel to the beam axes for reducing electron beam spherical aberration in a color CRT. The chain link-type common lens aperture may be employed in facing portions of adjacent electrodes in the main focus lens or in combination with either a facing solid or hollow common lens structure. This invention also contemplates facing hollow common lens structures in facing portions of adjacent electrodes in the electron gun's main focus lens. The chain link-type common lens aperture may be either disposed in an inwardly directed end wall of the electrode or it may be defined by a straight side wall of the electrode aligned with the electron gun axis.

OBJECTS AND SUMMARY OF THE INVENTION

Accordingly, it is an object of the present invention to provide spherical aberration reduction in an inline electron gun in a color CRT.

It is another object of the present invention to reduce center (or green) electron beam spot size in a COTY-type CRT in reducing for spherical aberration in a color CRT.

Yet another object of the present invention is to improve video image quality in a color CRT by reducing vertical spherical aberration for the green beam without compromising other CRT performance criteria.

A further object of the present invention is to provide a chain link-type of common lens design incorporated in facing portions of adjacent focus lens electrodes in an electron gun for reducing for video image vertical and horizontal spherical aberration for the three electron beams in a color CRT.

A still further object of the present invention is to reduce vertical spherical aberration in the center (green) electron beam in a color CRT by providing a chain link-type common lens design in a first focus electrode in combination with either a solid or hollow common lens structure in a facing portion of a second adjacent focus electrode.

Yet another object of the present invention is to reduce spherical aberration in a color CRT by means of hollow common lens structures in facing portions of adjacent focus electrodes in the CRT's electron gun.

Still another object of the present invention is to provide a back-to-back electrode arrangement particularly adapted for use in a COTY-type CRT which corrects for video image vertical spherical aberration for the green beam in a color CRT.

These objects of the present invention are achieved and the disadvantages of the prior art are minimized by an electrode in an electron gun for directing a center and two outer inline electron beams along respective parallel axes onto a display screen of a cathode ray tube (CRT) in forming a video image on the screen, the electrode comprising: a hollow housing open at first and second ends thereof and comprised of a thin sheet of metal forming a single closed lateral wall, wherein the lateral wall is aligned parallel with the axes and the first and second open ends each have a longitudinal axis aligned with the center and outer inline electron beams; means for defining first, second and third circular apertures disposed on the first end of the housing, wherein the apertures are arranged in a linear, spaced array across the first end of the housing and wherein each of the electron beams is directed through a respective one of the circular apertures; and means disposed on the second open end of the housing for defining a center and two outer enlarged portions extending generally transverse to the longitudinal axis, wherein each of the enlarged portions is aligned with a respective circular aperture and passes a respective electron beam for reducing spherical aberration of the electron beams on the display screen.

This invention further contemplates an electron gun for use in a color cathode ray tube (CRT) having a center and two outer electron beams arranged in inline alignment, wherein the electron beams are deflected across a display screen in the CRT in a synchronous manner by a magnetic deflection yoke, an electron gun comprising: cathodes for generating electrons; crossover means for receiving electrons from the cathodes and for forming a beam crossover; and first and second electrodes arranged in a spaced manner along the electron beams for applying an electrostatic focus field to the electron beams, wherein each of the electrodes includes a hollow common lens having a peripheral side wall of single layer thickness and defining an elongated common aperture having a longitudinal axis aligned with the inline electron beams and through which the electron beams pass, wherein the common apertures of each of the hollow common lenses are arranged in facing relation for reducing spherical aberration of the electron beams in a direction along the inline alignment of the electron beams.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 5*a* and 5*b* are sectional views of the electron gun of FIG. 5 respectively taken along site lines 5*a*—5*a* and 5*b*—5*b* therein;

FIGS. 6*a* and 6*b* are sectional views of the electron gun of FIG. 6 respectively taken along site lines 6*a*—6*a* and 6*b*—6*b* therein

FIG. 8*a* is a sectional view of the electron gun of FIG. 7 taken along site line 8*a*—8*a* therein;

FIG. 8*b* is a sectional view of the electron gun of FIG. 7 taken along site line 8*b*—8*b* therein;

DETAILED DESCRIPTION OF THE PREFERRED EMBODIMENTS

Figure 1:
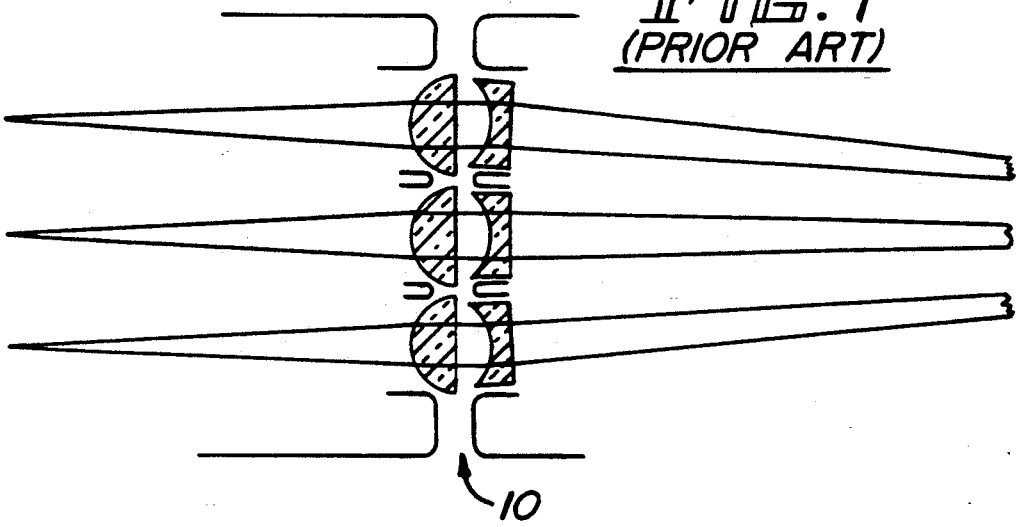
FIG. 1 (PRIOR ART)
FIG. 1 is a simplified sectional view of a prior art individual lens arrangement for three electron beams shown in the form of light beams as an optical analogy.
Figure 2A:
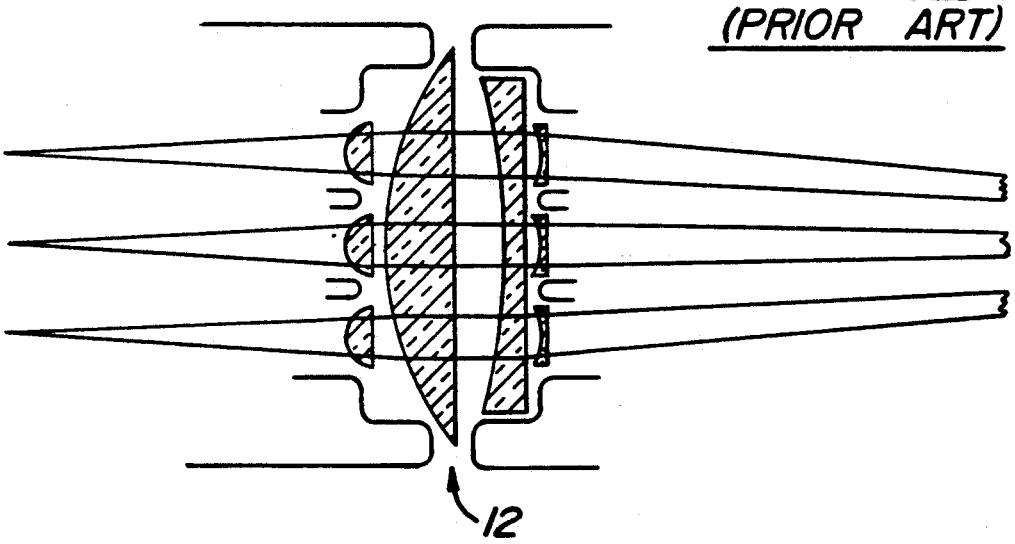
FIG. 2a (PRIOR ART)
FIGS. 2*a* and 2*b* are respectively simplified horizontal and vertical sectional views of an optical analogy of a prior art color CRT common lens.
Figure 2B:
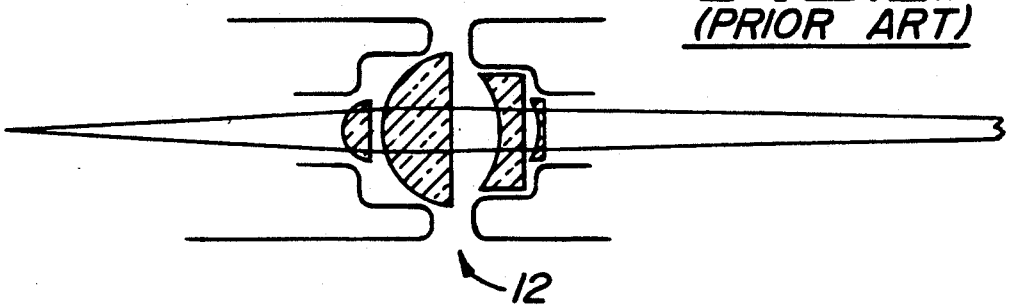
FIG. 2b (PRIOR ART)
Figure 3A:
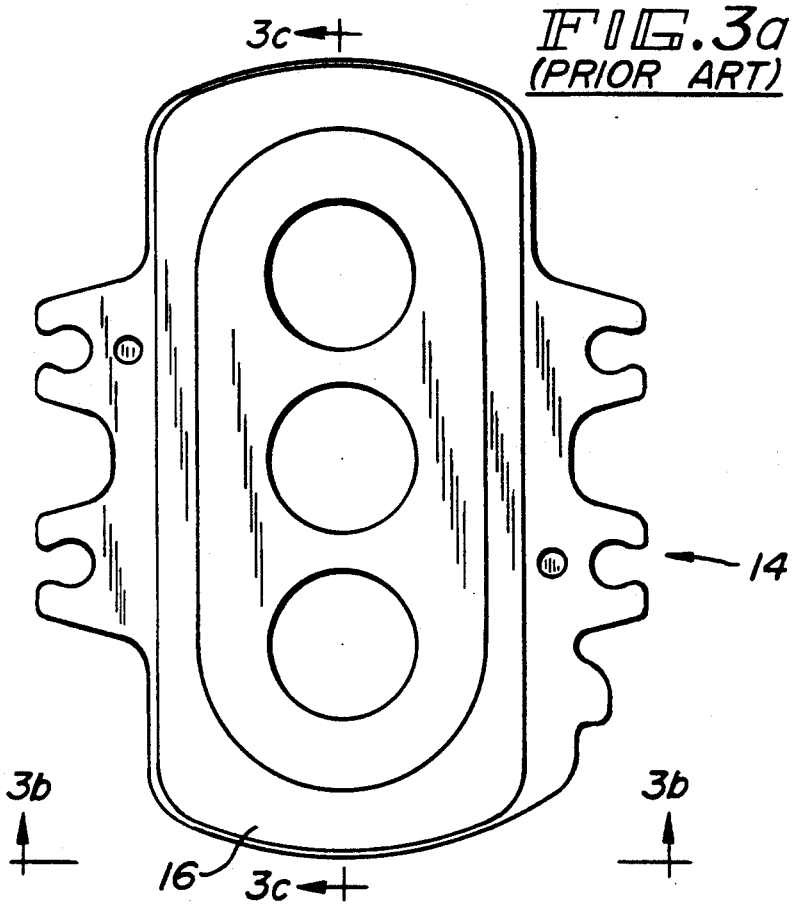
FIG. 3a (PRIOR ART)
FIGS. 3*a*, 3*b* and 3*c* are respectively plan, side and sectional views of a prior art solid common lens having a shared lens focusing space and including a doubly bent sheet of metal around its periphery.
Figure 3B:
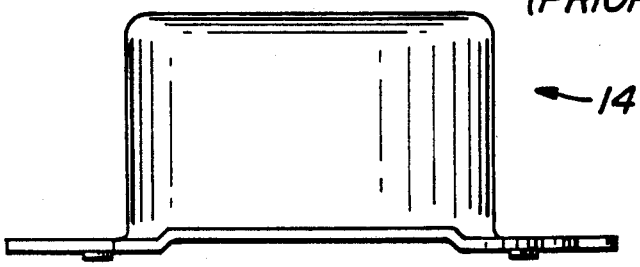
FIG. 3b (PRIOR ART)
Figure 3C:
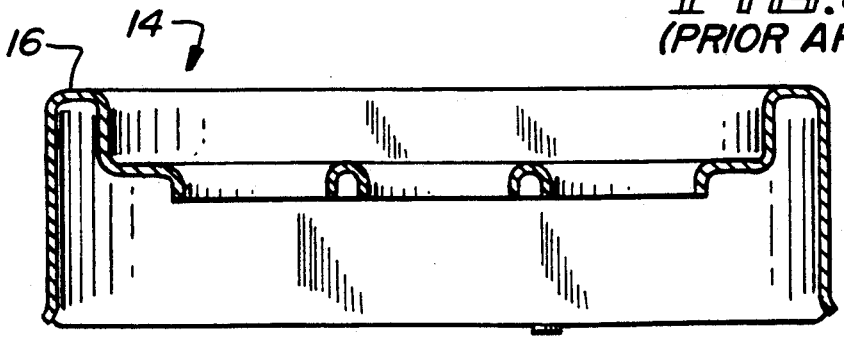
FIG. 3c (PRIOR ART)
Figure 4A:
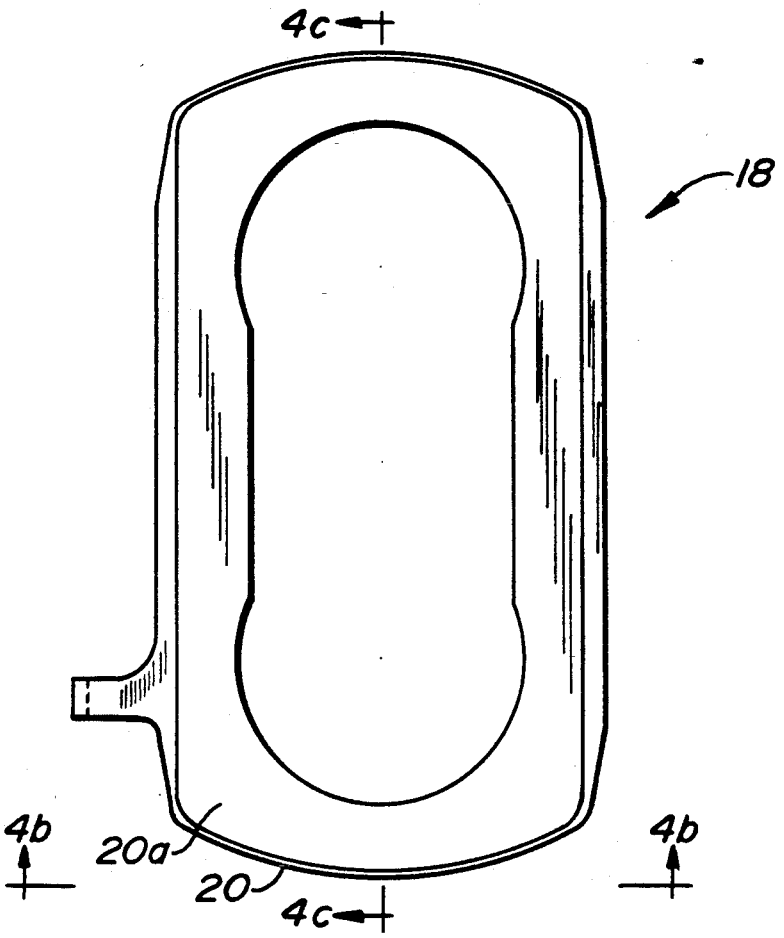
FIG. 4a (PRIOR ART)
FIGS. 4*a*, 4*b* and 4*c* are respectively plan, side and sectional views of a prior art hollow common lens also including a shared lens focusing space and having a single-layer sheet of metal about its periphery.
Figure 4B:
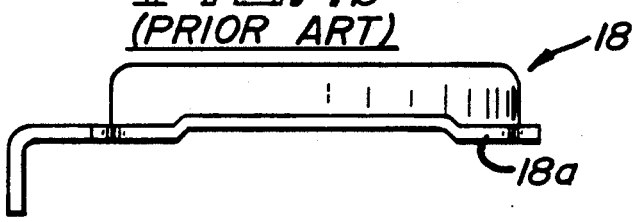
FIG. 4b (PRIOR ART)
Figure 4C:
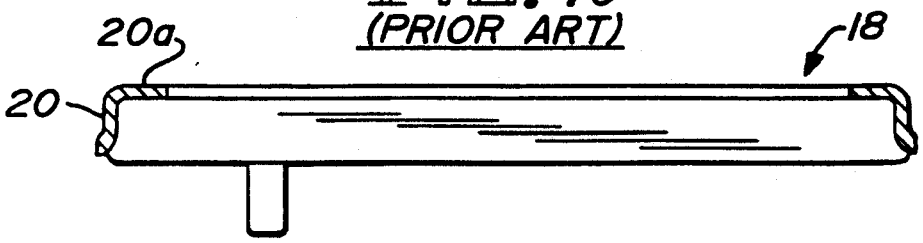
FIG. 4c (PRIOR ART)
Figure 5:
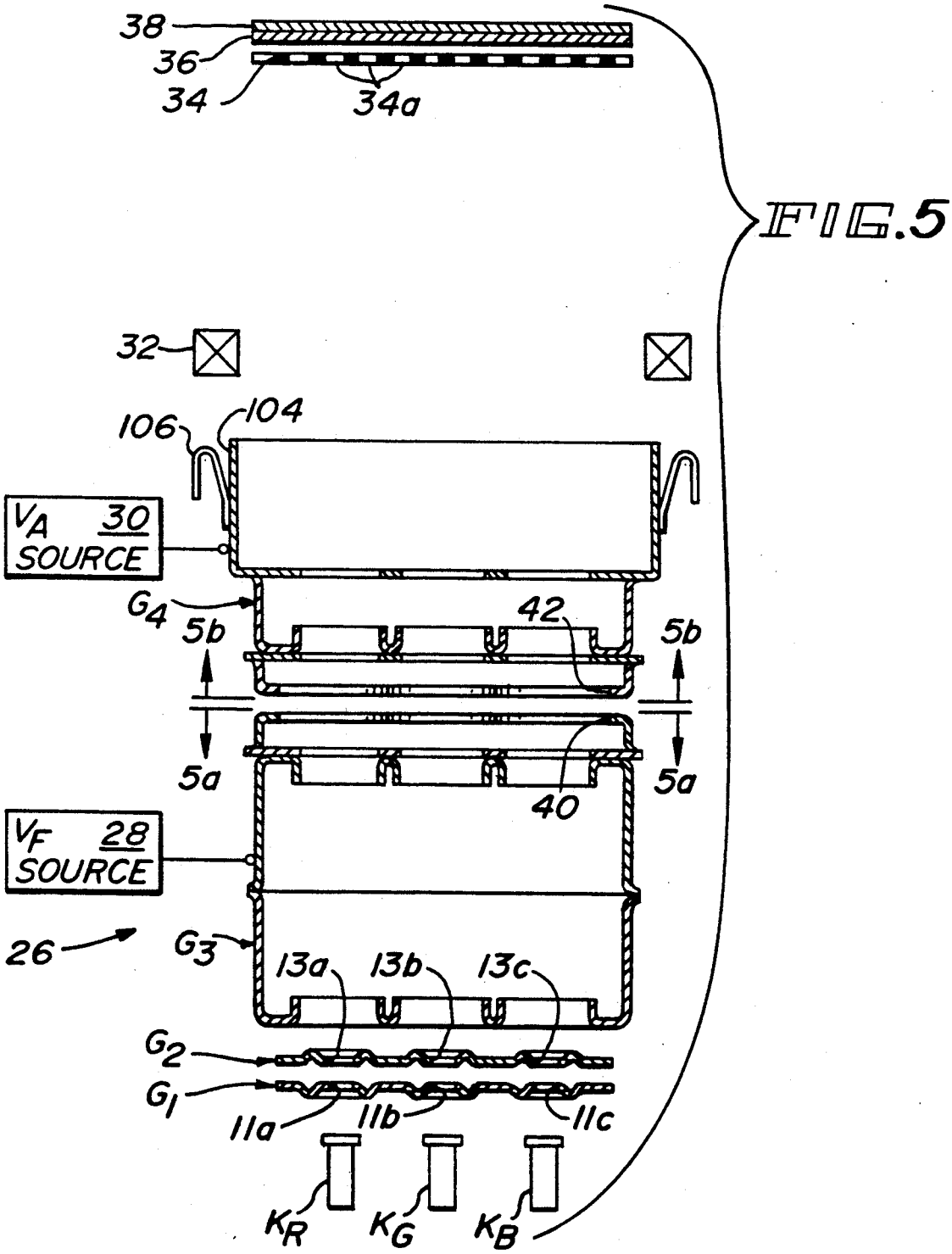
FIG. 5 is a simplified sectional view of a bipotential-type of electron gun in accordance with one embodiment of the present invention incorporating facing hollow common lens structures in adjacent $G_3$ and $G_4$ electrodes of the main focus lens of the electron gun.

Referring to FIG. 5, there is shown a simplified sectional view of a spherical aberration-corrected inline electron gun 26 in accordance with one embodiment of the present invention. The present invention is particularly adapted for spherical aberration reduction in a combined optimum tube and yoke (COTY) CRT. A COTY-type CRT employs an inline electron gun and allows the three electron guns to have a larger vertical lens while sharing the horizontal open space in the main lens for improved electron beam spot size. In FIG. 5 and subsequent figures discussed below, common elements performing essentially the same function are identified by the same element number throughout these figures.

The inline electron gun 26 is of the bipotential type and includes an electron beam source typically comprised of three cathodes: $K_R$ (red), $K_G$ (green) and $K_B$ (blue). Each cathode is typically comprised of a sleeve, a heater coil and an emissive layer (none of which are shown in FIG. 5 for simplicity), from which emitted electrons are focused to a crossover along the axis of the beam by the effect of an electrode commonly referred to as the $G_2$ screen electrode. An electrode known as the $G_1$ control electrode is disposed between the cathodes and the $G_2$ screen electrode and is operated at a negative potential relative to the cathodes and serves to control the intensity of the electron beams in response to the application of a video signal thereto, or to the cathodes. The afore-mentioned electron beams' first crossover is at that point where the electrons pass through a beam axis and is typically in the vicinity of the $G_2$ screen electrode. Each of the $G_1$ control and $G_2$ screen electrodes includes three aligned apertures, with corresponding apertures in each electrode in common alignment for passing a respective one of the red, green or blue color generating electron beams. The $G_1$ control electrode is typically maintained at zero volts. The $G_1$ control electrode includes electron beam passing apertures 11*a*, 11*b* and 11*c*, while the $G_2$ screen electrode includes electron beam passing apertures 13*a*, 13*b* and 13*c*.

Electron gun 26 further includes a $G_3$ electrode and a $G_4$ electrode disposed about the three electron beams and along the path of the energetic electrons as they travel toward the display screen 38 of a CRT. FIGS. 5*a* and 5*b* are sectional views of the electron gun 26 of FIG. 5 respectively taken along site lines 5*a*—5*a* and 5*b*—5*b* therein and illustrating the $G_4$-facing end of the $G_3$ electrode and the $G_3$-facing end of the $G_4$ electrode, respectively. The $G_3$ and $G_4$ electrodes are each coupled to a voltage source which may be of either the focusing or accelerating type. Thus, as shown in FIG. 5, the $G_3$ electrode is coupled to a focus voltage ($V_F$) source 28, while the $G_4$ electrode is coupled to an accelerating anode voltage ($V_A$) source 30. The $G_3$ and $G_4$ electrodes form what is generally termed the "main lens" of electron gun 26. Attached to the $G_4$ electrode is a conductive support, or convergence, cup 104 which includes a plurality of spaced bulb spacers 106 disposed about the circumference thereof. The support cup 104 and bulb spacer 106 combination is conventional and serves to securely maintain electron gun 26 in position in the neck portion of a CRT's glass envelope which is not shown in the figures for simplicity. Each of the aforementioned electrodes is coupled to and supported by glass beads (also not shown for simplicity) disposed in the glass envelope's neck portion.

After being subjected to the electrostatic fields produced by the accelerating and focusing voltages applied by the aforementioned electrodes, the focused electron beams are then directed through a magnetic deflection yoke 32 which is typically the self-converging type, for deflecting the electron beams in a raster-like manner across a phosphor coating, or layer, 36 on the inner surface of the CRT's display screen, or glass faceplate, 38. Disposed adjacent to the inner surface of the CRT's screen 38 is a shadow mask 34 having a large number of apertures 34*a* therein. Shadow mask 34 serves as a color selection electrode for producing selective energization of predetermined phosphor elements within the phosphor coating 36 by each of the respective electron beams. The accelerating voltage of $V_A$ is substantially higher than the focus voltage $V_F$ and serves to cooperate with $V_F$ in the electron gun 26 to focus and accelerate the electrons toward the phosphor coated display screen 38. $V_A$ is typically on the order of three or four times the magnitude of $V_F$, where $V_A$ generally has a value on the order of 30 kV and $V_F$ is on the order of 7–9 kV.

As shown in FIG. 5 and in FIGS. 5*a* and 5*b*, each of the $G_3$ and $G_4$ electrodes has a respective elongated common aperture 40 and 42 in facing relation to the other electrode, which electrode combination forms the main focus lens of electron gun 26. The facing portions of the $G_3$ and $G_4$ electrodes are each commonly referred to as the common lens portion of the electrode because all three electron beams transit the single elongated, chain link-shaped apertures 40 and 42 respectively in the $G_3$ and $G_4$ electrodes. The elongated, chain link-shaped apertures 40, 42 respectively in the $G_3$ and $G_4$ electrodes provide an increased lens diameter for the three electron beams in the horizontal dimension (in the plane of FIG. 5) to allow for reduction in the horizontal dimension of each of the three electron beam spot sizes on the display screen's phosphor coating 36. Vertical spherical aberration correction is also provided by the hollow common lens electrode combination, particularly for the two outer electron beams. Spherical aberration reduction in the three electron beams reduces each of their spot sizes on display screen 38 without diminishing other performance parameters of electron gun 26. The use of facing main focus electrodes in a COTY-type CRT incorporating facing elongated, chain link-shaped apertures in adjacent hollow common lens electrodes improves video image resolution by reducing electron beam spherical aberation in accordance with the present invention.

Figure 6:
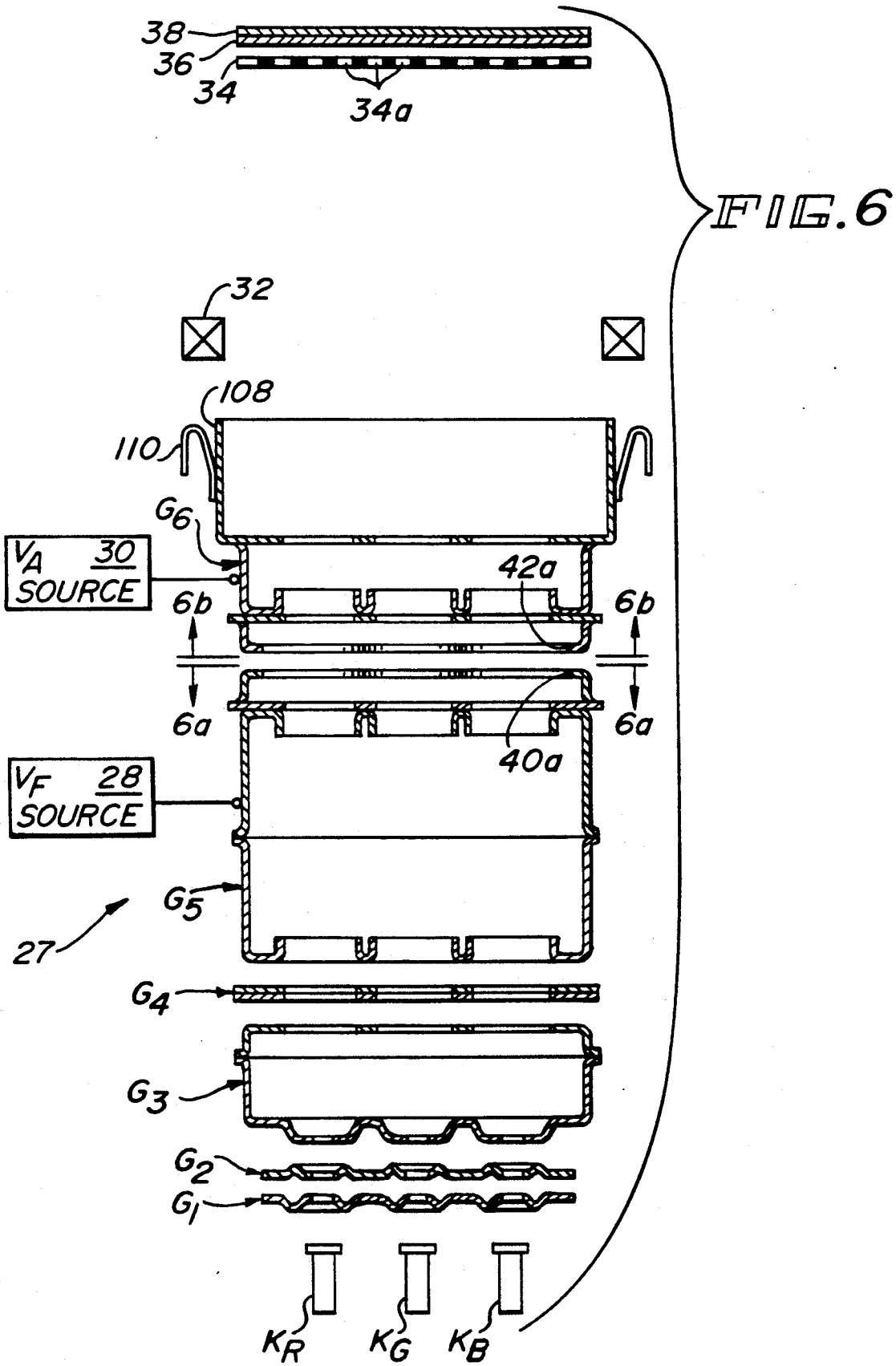
FIG. 6 is a simplified sectional view of a QPF-type of electron gun in accordance with another embodiment of the present invention incorporating facing chain link-shaped hollow common lens structures in adjacent $G_5$ and $G_6$ electrodes of the main focus lens of the electron gun.

Referring to FIG. 6, there is shown a simplified sectional view of another embodiment of a spherical aberration-corrected inline electron gun 27 in accordance with another embodiment of the present invention. Electron gun 27 is of the QPF-type and, as in the case of the electron gun 26 shown in FIG. 5, includes three cathodes $K_R$, $K_G$ and $K_B$, a $G_1$ control electrode, a $G_2$ screen electrode and a $G_4$ electrode. Electron gun 27 further includes a $G_5$ electrode coupled to a focus voltage ($V_F$) source 28 and a $G_6$ electrode coupled to and charged by an accelerating voltage ($V_A$) source 30. The $G_5$ and $G_6$ electrodes form what is generally termed the "main lens" of the QPF-type electron gun 27 for focusing the three electron beams on the CRT's screen 38 which has a phosphor coating 36 on the inner surface thereof. Electron beams transit apertures 34*a* within a shadow mask 34 and are deflected across the display screen 38 by means of a magnetic deflection yoke 32 as previously described.

As shown in the sectional views of FIGS. 6*a* and 6*b* which are respectively taken along site lines 6*a*—6*a* and 6*b*—6*b* in FIG. 6, facing portions of the $G_5$ and $G_6$ electrodes include elongated chain link-shaped apertures 40*a* and 42*a*, respectively. The facing portions containing the chain link-shaped elongated apertures of the $G_5$ and $G_6$ electrodes are each commonly referred to as the common lens portion of the electrode because all three electron beams transit the elongated apertures 40*a* and 42*a*, respectively in the $G_5$ and $G_6$ electrodes. The chain link-shaped elongated apertures 40*a*, 42*a* in the $G_5$ and $G_6$ electrodes provide an increased lens diameter for the three electron beams in the horizontal direction, or in the plane of FIG. 6. The increased horizontal dimension of these facing beam passing apertures allows for a reduction in the horizontal dimension of each of the three electron beam spot sizes on the CRT's display screen 38. Vertical spherical aberration is also reduced by the hollow common lens $G_5$ and $G_6$ electrode cobmination, particularly for the two outer electron beams. The increased vertical dimension of each of the three beam passing portions of each of the elongated, chain link-shaped apertures 40*a* and 42*a* shown in FIGS. 6*a* and 6*b* provides a larger beam passing aperture which allows for reduction in the vertical dimension of each of the three electron beam spots on the CRT's display screen 38. In this manner, the use of facing main focus electrodes in a COTY-type CRT incorporating facing elongated, chain link-shaped common apertures in the adjacent hollow common lens $G_5$ and $G_6$ electrodes improves video image resolution by reducing electron beam spherical aberration.

Figure 7:
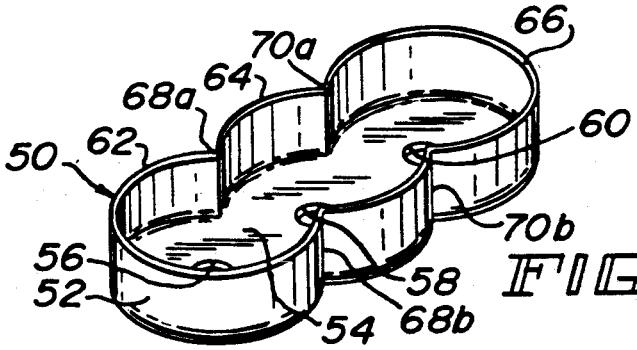
FIG. 7 is a perspective view of a chain link-type, straight wall hollow common lens electrode for use in the main lens of a multi-beam electron gun in accordance with another embodiment of the present invention.

Referring to FIG. 7, there is shown a perspective view of a chain link-shaped, straight-walled, hollow common electrode 50 in accordance with another aspect of the present invention. The chain link-shaped, straight-walled, hollow common electrode 50 is comprised of a straight side wall 52 having a first open end and a second closed end over which is disposed a first end wall 54. The end wall 54 may be formed integrally with side wall 52 such as in a stamping operation or it may be formed separately from side wall and attached thereto by conventional means such as weldments. Electrode 50 is preferably comprised of a highly conductive metal. End wall 54 is provided with first and second outer apertures 56 and 60 and a center aperture 58. Each of the apertures 56, 58 and 60 is generally circular with the spacing between the center aperture and each of the two outer apertures being equal. The first and second outer apertures 56, 60 are adapted to pass a respective outer electron beam, while center aperture 58 is adapted for passing the center electron beam. The open end of side wall 52 forms a common lens structure through which all three electron beams pass. The length of the common lens portion of the chain link-shaped hollow common electrode 50 is aligned with the inline electron beams and provides horizontal spherical aberration correction for the electron beams which transit the electrode.

Side wall 52 has a general chain link shape and includes two spaced pairs of inwardly directed recesses 68*a*, 68*b* and 70*a*, 70*b*. End wall 54 has a corresponding chain link shape for positioning over an open end portion of side wall 52. The first and second pairs of inwardly directed recesses 68*a*, 68*b* and 70*a*, 70*b* form side wall 52 into first and second outer arcuate portions 62 and 66 and a center arcuate portion 64. Each of the first and second outer arcuate portions 62, 66 as well as the center arcuate portion 64 has a generally circular shape, with the first and second outer arcuate portions aligned concentrically with the first and second outer apertures 56, 60, respectively, and the center arcuate portion aligned concentrically with the center aperture 58. The open, common portion of electrode 50 extending the length thereof corrects for horizontal spherical aberration of the three electron beams directed through apertures 56, 58 and 60. Similarly, the first and second outer arcuate portions 62, 66 correct for vertical spherical aberration for the two outer electron beams respectively directed through outer apertures 56 and 60. The center arcuate portion 64 corrects for vertical spherical aberration for the center electron beam directed through the center aperture 58.

Figure 8:
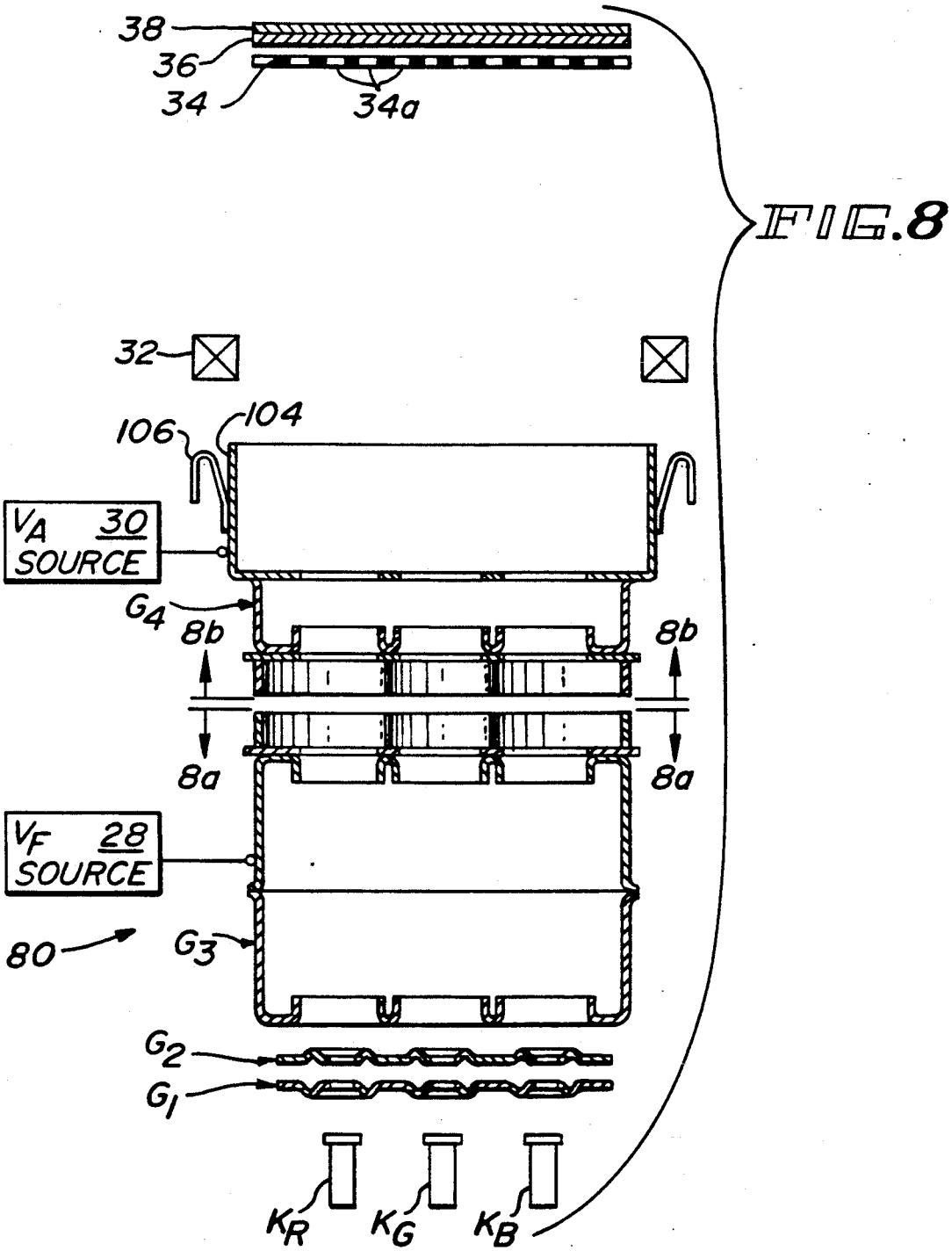
FIG. 8 is a simplified sectional view of a bipotential-type of electron gun incorporating the inventive chain link-type, straight wall hollow common lens structure in adjacent $G_3$ and $G_4$ electrodes in accordance with one embodiment of the present invention.

Referring to FIG. 8, there is shown a simplified sectional view of an electron gun 80 incorporating a pair of chain link-shaped, straight-walled, hollow common electrodes in accordance with another embodiment of the present invention. As in the previously described electron gun, electron gun 80 includes three inline cathodes $K_R$, $K_G$ and $K_B$. Disposed adjacent the three cathodes is a $G_1$ control electrode and a $G_2$ screen electrode which each include three spaced apertures aligned with a respective cathode for receiving the energetic electrons and forming the electrons into three electron beams directed toward the display screen of a CRT.

Disposed intermediate the $G_2$ screen electrode and display screen 38 is a $G_3$ electrode and a $G_4$ electrode, which combination forms the main focus lens of electron gun 80 for focusing the three electron beams to a spot on the display screen. The $G_3$ electrode is coupled to a focus voltage $V_F$ source 28, while the $G_4$ electrode is coupled to an anode voltage $V_A$ source 30 as in the previously described embodiment. Each of the $G_3$ and $G_4$ electrodes is a chain link-shaped hollow common electrode as illustrated in FIG. 7, with the open common lens portions of each of the $G_3$ and $G_4$ electrodes in facing relation in electron gun 80. Thus, as shown in the sectional view of FIG. 8*a* taken along site line 8*a*—8*a* in FIG. 8, the side of the $G_3$ electrode facing the $G_4$ electrode includes the elongated common lens portion of the $G_3$ electrode with the opposing side thereof including the electrode's end wall 96. End wall 96 is disposed over the $G_3$ electrode's side wall 94 and includes spaced first and second outer beam passing apertures 98 and 102 and a center beam passing aperture 100 disposed therebetween. Each of the aforementioned apertures is generally circular, with the first and second outer apertures 98, 102 concentrically disposed with respect to first and second outer arcuate portions 107, 109, respectively, in side wall 94. Center aperture 100 is concentrically disposed with respect to a center arcuate portion 105 in side wall 94. As shown in the sectional view of FIG. 8*b* taken along site line 8*b*—8*b* in FIG. 8, the $G_4$ electrode is also a hollow common electrode with a chain link-shaped aperture and is essentially identical to the $G_4$ electrode in electron gun 80 as well as to the electrode 50 shown in FIG. 7.

Figure 9:
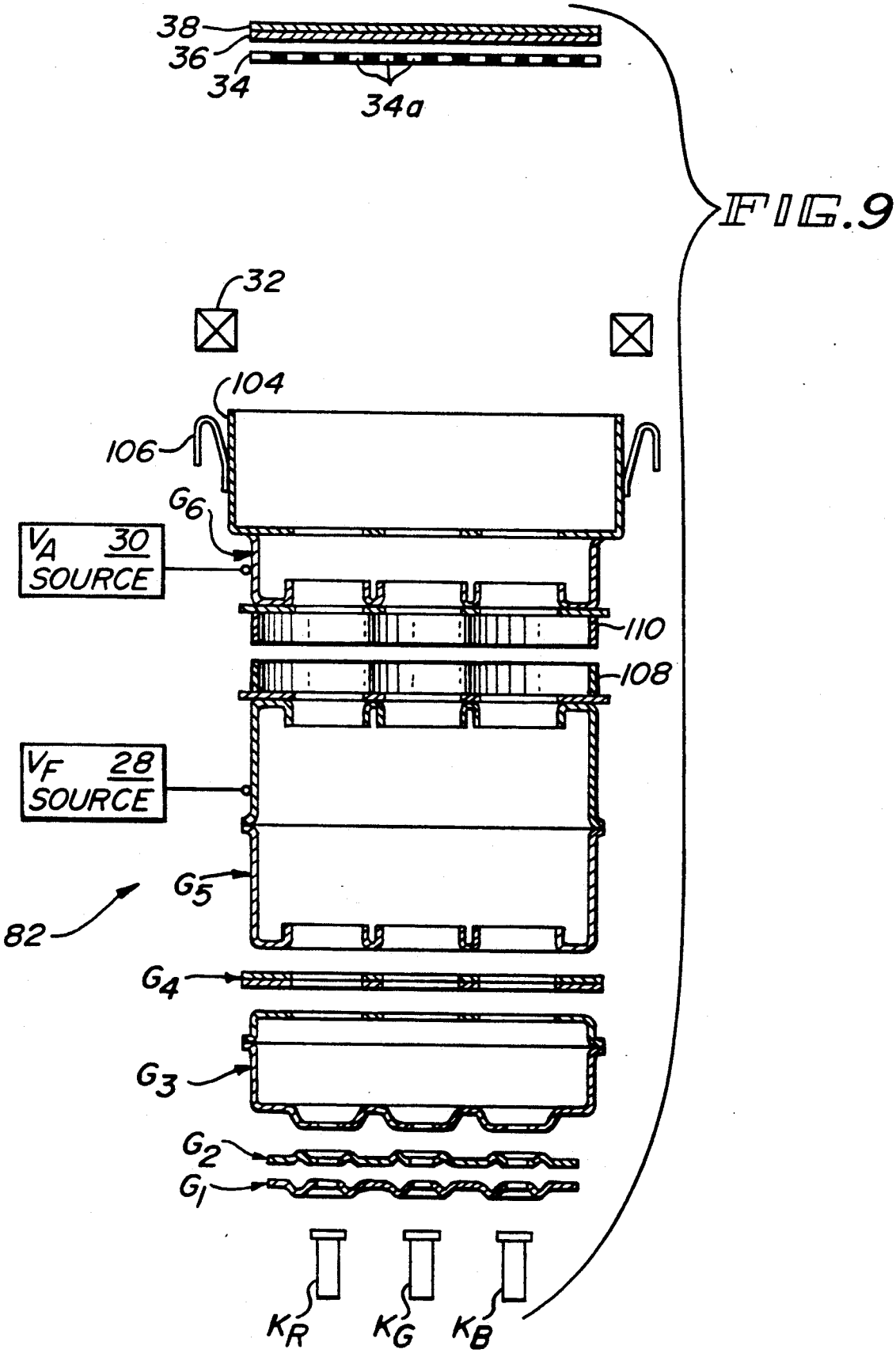
FIG. 9 is a simplified sectional view of a QPF-type of electron gun incorporating the inventive chain link-type, straight wall hollow common lens structure in adjacent $G_5$ and $G_6$ electrodes in accordance with another embodiment of the present invention.

Referring to FIG. 9, there is shown a sectional view of a QPF-type electron gun 82 in accordance with another embodiment of the present invention. As in the previously described embodiments, electron gun 82 includes cathodes $K_R$, $K_G$ and $K_B$ as well as $G_1$ and $G_2$ electrodes comprising a beam forming region in the electron gun. The electron beams are directed onto the phosphor layer 36 on a display screen 38 through a shadow mask 34 and are deflected across the display screen by means of a magnetic deflection yoke 32. The QPF-type electron gun 82 further includes the combination of a $G_3$ and a $G_4$ electrode each having a plurality of apertures aligned along an electron beam axis for passing a respective electron beam. In accordance with this embodiment of the invention, electron gun 82 further includes a $G_5$ electrode coupled to and charged by a focus voltage ($V_F$) source 28 and a $G_6$ electrode coupled to and charged by an accelerating voltage ($V_A$) source 30. The $G_5$ and $G_6$ electrode combination forms the high voltage electron beam focus lens of electron gun 82. Attached to the $G_6$ electrode is the combination of a support cup 104 and a plurality of bulb spacers 106 as in the previous embodiments. Facing portions of the $G_5$ and $G_6$ electrodes are comprised of respective chain link-shaped common aperture electrode portions 108 and 110, respectively. Each of the facing chain link-shaped electrode portions 108, 110 in the $G_5$ and $G_6$ electrodes is shaped and configured in accordance with the electrode shown in FIG. 7 and described above. As shown in FIG. 9, the facing chain link-shaped electrode portions 108 and 110 of the $G_5$ and $G_6$ electrodes include respective straight side walls which do not extend inwardly toward the electron beam axes. The chain link-shaped common aperture electrode portions 108, 110 thus provide a hollow common lens for the three electron beams. The open common portion of these facing electrodes aligned with the electron beam axes reduces horizontal spherical aberration of the three electron beams, while the center and two outer arcuate portions concentrically align with a respective electron beam reduces vertical spherical aberration of the three electron beams.

Figure 10:
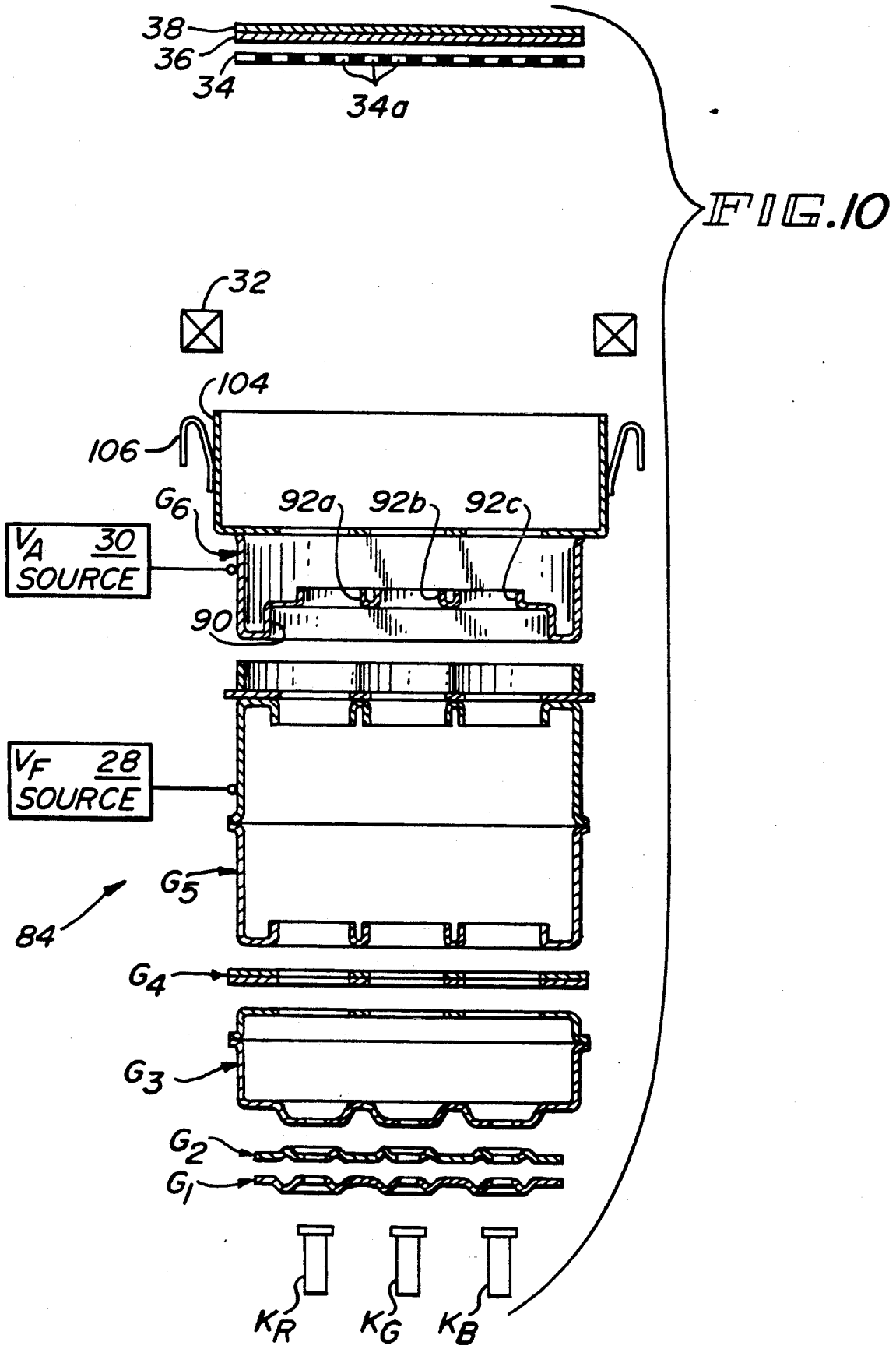
FIG. 10 is a simplified sectional view of an electron gun incorporating facing chain link-type, straight wall hollow common lens and solid common lens structures in adjacent focus electrodes in accordance with yet another embodiment of the present invention.

Referring to FIG. 10, there is shown a simplified sectional view of yet another embodiment of an electron gun 84 in accordance with the principles of the present invention. In electron gun 84, the portion of the $G_5$ electrode in facing relation to the $G_6$ electrode is in the form of a chain link-shaped, straight-walled, hollow common electrode as shown in FIG. 7. The portion of the $G_6$ electrode in facing relation to the $G_5$ electrode is in the form of a solid common lens having an elongated common aperture 90 through which the three electron beams are directed. The common aperture 90 in the $G_6$ electrode terminates in three inner circular apertures 92*a*, 92*b* and 92*c*, through each of which a respective electron beam is directed onto display screen 38.

There has thus been shown a chain link-shaped hollow common electrode for use in the main focus lens of an electron gun for providing correction for horizontal as well as vertical spherical aberration of electron beams incident upon the display screen of a CRT. The chain link hollow common electrode may be used in facing relation with a similarly configured electrode in the electron gun's main lens, or it may be used in combination with either a conventional solid or hollow common lens in correcting for electron beam spherical aberration. In the various embodiments, the common lens portions of the chain link hollow common electrode and either the conventional solid or hollow common lens are in facing relation in the adjacent electrodes. The chain link hollow common electrode includes a single, thin, continuous side wall which is open at both ends and parallel to an electron beam axis. One open end is covered by an end wall having a spaced pair of outer apertures and a center aperture disposed therebetween, where the three apertures are arranged in a linear array in accordance with the inline configuration of the three electron beams. The second end of the hollow common electrode is open and forms a common lens portion through which the three electron beams are directed for horizontal spherical aberration correction. Concentrically aligned with each of the three apertures in the electrode's end wall is a respective enlarged arcuate portion for reducing beam vertical spherical aberration, or spherical aberration in a direction generally transverse to the plane of the three beams. The vertically increased dimension of the common aperture aligned with each of the three electron beams allows each of the beams to be focused to a smaller spot size on the CRT display screen's phosphor layer for improved video image resolution. The spherical aberration-corrected inline electron gun is particularly adapted for use in a COTY-type CRT in that it includes a pair of charged electrodes, having facing common lens portions, with each of the three electron beams directed through the combination of a circular aperture and an elongated aperture in each of the aforementioned electrodes.

While particular embodiments of the present invention have been shown and described, it will be obvious to those skilled in the art that changes and modifications may be made without departing from the invention in its broader aspects. Thus, while the chain link-shaped hollow common electrode of the present invention has been disclosed as comprising the $G_3$, $G_4$, $G_5$ or $G_6$ electrode, the inventive electrode is not limited to use in one of the aforementioned electron gun electrodes but may be used in virtually any multi-electron beam focusing electrode. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An electrode in an electron gun for directing a center and two outer inline electron beams along respective parallel axes onto a display screen of a cathode ray tube (CRT) in forming a video image on said screen, said electrode comprising:

a hollow housing open at first and second ends thereof and comprised of a thin sheet of metal forming a single closed lateral wall, wherein said lateral wall is aligned parallel with said axes and said first and second open ends are each chain link-shaped and have a longitudinal axis aligned with the center and outer inline electron beams;

means for defining first, second and third circular apertures disposed on said first end of said housing, wherein said apertures are arranged in a linear, spaced array across the first end of said housing and wherein each of said electron beams is directed through a respective one of said circular apertures; and means disposed on said second open end of said housing for defining a center and two outer enlarged portions formed by said single closed lateral wall and extending generally transverse to said longitudinal axis, wherein each of said enlarged portions is aligned with a respective circular aperture and passes a respective electron beam for reducing spherical aberration of the electron beams on the display screen.

2. The electrode of claim 1 wherein each enlarged portion is defined by arcuate expanded portions in the second open end of said housing.

3. The electrode of claim 2 wherein said arcuate expanded portions extend the length of said hollow housing intermediate the first and second open ends thereof.

4. The electrode of claim 1 wherein said means for defining said first, second and third apertures includes a generally flat panel disposed over the first end of said housing and including said first, second and third apertures.

5. The electrode of claim 1 wherein said electron gun includes a high voltage electron beam focus lens and wherein said electrode is in said high voltage electron beam focus lens.

6. The electrode of claim 5 wherein said electrode is a $G_3$, $G_4$, $G_5$ or $G_6$ electrode in the electron gun.

7. For use in a color cathode ray tube (CRT) having a center and two outer inline electron beams, wherein said electron beams are deflected across a display screen in the CRT in a synchronous manner by a magnetic deflection yoke, an electron gun comprising:

cathode means for generating electrons;

crossover means for receiving electrons from said cathode means and for forming a beam crossover; and first and second electrode means arranged in a spaced manner along the electron beams for applying an electrostatic focus field to the electron beams, wherein each of said electrode means includes a hollow common lens having a peripheral side wall of single layer thickness and defining an elongated common aperture having a longitudinal axis aligned with the inline electron beams and through which the electron beams pass, wherein said common apertures of each of said hollow common lenses are chain link-shaped and are arranged in facing relation for reducing spherical aberration of the electron beams in a direction along the inline alignment of the electron beams, and wherein each of said first and second electrode means includes a peripheral side wall conforming with the chain link shape of said common aperture of said electrode means.

8. The electrode of claim 7 wherein each of said chain link-shaped common apertures includes a plurality of spaced enlarged arcuate portions each aligned with a respective electron beam.

9. The electrode of claim 8 wherein each of said chain link-shaped common apertures includes first and second outer arcuate portions and a third inner arcuate portion disposed therebetween.

10. The electron gun of claim 9 wherein said first electrode means comprises a $G_3$ electrode and said second electrode means comprises a $G_4$ electrode in a high voltage focus lens of said electron gun.

11. The electron gun of claim 10 wherein said $G_3$ electrode is coupled to a focusing voltage source and said $G_4$ electrode is coupled to an accelerating voltage source.

12. The electron gun of claim 9 wherein each of said first electrode means comprises a $G_5$ electrode and said second electrode means comprises a $G_6$ electrode in a high voltage focus lens of said electron gun.

13. The electron gun of claim 12 wherein said $G_5$ electrode is coupled to a focusing voltage source and said $G_6$ electrode is coupled to an accelerating voltage source.

14. The electron gun of claim 13 wherein said peripheral side wall of said electrode means is aligned with and generally parallel to the longitudinal axis of said elongated common aperture.

15. For use in a color cathode ray tube (CRT) having a center and two outer inline electron beams, wherein said electron beams are deflected across a display screen in the CRT in a synchronous manner by a magnetic deflection yoke, an electron gun comprising:

cathode means for generating electrons;

crossover means for receiving electrons from said cathode means and for forming a beam crossover; and first and second facing electrodes arranged in a spaced manner along the electron beams for applying an electrostatic field to the electron beams in focusing the electron beams on the display screen, wherein said electrodes include respective chain link-shaped, hollow common lenses arranged in facing relation and a pair of outer apertures and a center aperture each aligned with a respective electron beam, and wherein each of said hollow common lenses includes a pair of outer enlarged portions and a center enlarged portion respectively aligned with said outer apertures and said center aperture for passing a respective electron beam for reducing spherical aberration of the electron beams on the display screen, and wherein each of said first and second electrodes further includes a peripheral side wall conforming with said chain link-shaped, hollow common lens including a pair of outer enlarged portions and a center enlarged portion.

16. For use in a color cathode ray tube (CRT) having a center and two outer inline electron beams, wherein said electron beams are deflected across a display screen in the CRT in a synchronous manner by a magnetic deflection yoke, an electron gun comprising:

cathode means for generating electrons;

crossover means for receiving electrons from said cathode means and for forming a beam crossover;

a first hollow common lens electrode disposed intermediate said first crossover means and said display screen and having a peripheral side wall of single layer thickness and defining a first elongated common lens aperture having a longitudinal axis aligned with the inline electron beams and through which the electron beams pass; and a second hollow common lens electrode disposed intermediate said first hollow common lens electrode and said display screen and including a second hollow common lens aperture in facing relation to the first common lens aperture of said first electrode and having a peripheral side wall of single layer thickness and a longitudinal axis aligned with the inline electron beams, and wherein the electron beams pass through said second hollow common lens aperture, said second electrode further including a second opposed closed end portion defining first and second outer apertures and a center aperture each aligned with and passing a respective electron beam, said second hollow common lens aperture including first and second outer enlarged portions and a center enlarged portion each aligned with a respective electron beam and disposed intermediate first and second end portions of said side wall for reducing spherical aberration of the electron beams on the display screen, wherein said second hollow common lens electrode includes a peripheral side wall following said second hollow common lens aperture including first and second outer enlarged portions and a center enlarged portion.

17. For use in a color cathode ray tube (CRT) having a center and two outer inline electron beams, wherein said electron beams are deflected across a display screen in the CRT in a synchronous manner by a magnetic deflection yoke, an electron gun comprising:

cathode means for generating electrons;

crossover means for receiving electrons from said cathode means and for forming a beam crossover;

a first solid common lens electrode disposed intermediate said crossover means and the display screen and including a common lens aperture continuous with first and second outer apertures and a center aperture disposed within said first electrode, wherein each of said outer apertures and said inner aperture is aligned with and passes a respective electron beam; and a second hollow common lens electrode disposed intermediate said first solid common lens electrode and said cathode means and including a hollow common lens aperture in facing relation to the common lens aperture of said first electrode and having a peripheral side wall of single layer thickness and a longitudinal axis aligned with the inline electron beams, and wherein the electron beams pass through said hollow common lens aperture, said second electrode further including a second opposed closed end portion defining first and second outer apertures and a center aperture each aligned with and passing a respective electron beam, said second electrode further including first and second outer enlarged portions and a center enlarged portion each aligned along a respective electron beam and formed in said side wall for reducing spherical aberration of the electron beams on the display screen.

* * * * *

UNITED STATES PATENT AND TRADEMARK OFFICE

CERTIFICATE OF CORRECTION

PATENT NO. : 5,241,240

DATED : August 14, 1993

INVENTOR(S) : Chen et al.

It is certified that error appears in the above-indentified patent and that said Letters Patent is hereby corrected as shown below:

ON THE COVER PAGE:

Asignee: Chunghwa Picture Tubes, Ltd. is located in the "Republic of China", not in "China".

Other Publications:

Dynamic Astigmatism Control Quadra Potential Focus Gun or 21-in. Flat Square Color Display Tube, is -- SID 88--, not "SID 8".

Signed and Sealed this

Twenty-sixth Day of April, 1994

Bruce Lehman

Attest:

BRUCE LEHMAN

Attesting Officer

Commissioner of Patents and Trademarks